US006401943B1

(12) United States Patent
Root

(10) Patent No.: US 6,401,943 B1
(45) Date of Patent: Jun. 11, 2002

(54) TOOTHBRUSH HOLDER

(76) Inventor: Tracy Root, 24 King St., Box 708, Sconset, MA (US) 02564

( * ) Notice: Subject to any disclaimer, the term of this patent is extended or adjusted under 35 U.S.C. 154(b) by 0 days.

(21) Appl. No.: 09/548,611

(22) Filed: Apr. 13, 2000

(51) Int. Cl.[7] ..... A47B 81/02

(52) U.S. Cl. ..... 211/65; 248/109; 248/110; D6/528; D6/534; 206/362.1

(58) Field of Search ..... 211/65, 66; D6/528, D6/530, 534, 531; 248/210, 110, 104.1, 113, 206.3; 206/362.1

(56) References Cited

U.S. PATENT DOCUMENTS

| | | | | | |
|---|---|---|---|---|---|
| 132,089 | A | | 10/1872 | Lewis | |
| 288,058 | A | | 11/1883 | Hollister | |
| 1,356,487 | A | * | 10/1920 | Cluxton | 211/65 |
| 1,404,755 | A | | 1/1922 | Gay | |
| 1,487,085 | A | | 3/1924 | Blackshear | |
| D65,892 | S | * | 11/1924 | Baker | D6/528 |
| 1,551,434 | A | * | 8/1925 | Shiffer | 211/65 |
| 1,972,532 | A | * | 9/1934 | McMillan | 248/49 |
| 2,340,521 | A | | 2/1944 | Engert | 248/312 |
| D148,431 | S | * | 1/1948 | Lund | D86/10 |
| 2,616,647 | A | * | 11/1952 | Murchison | 248/110 |
| 2,642,999 | A | * | 6/1953 | McPherson | 211/65 |
| D176,162 | S | * | 11/1955 | Steece | D4/3 |
| 2,916,155 | A | | 12/1959 | Elliott | 211/66 |
| 2,917,182 | A | * | 12/1959 | Browne | 211/65 |
| 2,957,584 | A | * | 10/1960 | Jenkins | 211/65 |
| 3,002,630 | A | | 10/1961 | Heisser | 211/65 |
| D215,100 | S | * | 9/1969 | Seller | D33/27 |
| D232,790 | S | * | 9/1974 | Kalnins | D6/91 |
| 4,008,808 | A | * | 2/1977 | Ramsay | 211/65 |
| 4,085,867 | A | | 4/1978 | Heller | 222/181 |
| D250,305 | S | * | 11/1978 | Primiano et al. | D6/86 |
| 4,334,621 | A | * | 6/1982 | Weber | 211/60 M |
| 4,488,327 | A | * | 12/1984 | Snider | 15/111 |
| 4,583,647 | A | * | 4/1986 | Schinzing | 211/60.1 |
| 4,607,752 | A | * | 8/1986 | Sherrow | 211/65 |
| 4,722,113 | A | | 2/1988 | Olsson | 15/257 R |
| D301,976 | S | | 7/1989 | Greenhut et al. | D8/373 |
| D306,811 | S | | 3/1990 | DeLeon | D6/531 |
| 4,979,708 | A | * | 12/1990 | Aoki | 248/110 |
| 4,995,509 | A | * | 2/1991 | Kornfeind | 206/209.1 |
| D320,123 | S | * | 9/1991 | Wolf et al. | D6/534 |
| 5,259,519 | A | | 11/1993 | Lieberman | 211/66 |
| 5,335,799 | A | | 8/1994 | Coudron | 211/65 |
| D356,915 | S | * | 4/1995 | Torres et al. | D6/534 |
| 5,996,816 | A | * | 12/1999 | Bernard | 211/65 |
| D425,349 | S | * | 5/2000 | Adkins | D6/528 |
| 6,089,383 | A | * | 7/2000 | Heneveld | 211/14 |

* cited by examiner

*Primary Examiner*—Daniel P. Stodola
*Assistant Examiner*—Khoa Tran
(74) *Attorney, Agent, or Firm*—Pennie & Edmonds LLP

(57) ABSTRACT

A disposable holder comprising: a first member and a second member, wherein the first member is a disposable carrier comprising a substantially horizontal carrier plate having at least one opening for receiving a toothbrush; a substantially vertical wall connected to the carrier plate to extend upwardly therefrom; and at least two mounting pins connected to a bottom surface of the carrier plate and opposite the vertical wall; and wherein the second member is a mounting bracket for holding the disposable carrier comprising: a substantially vertical back wall; a substantially horizontal support plate extending outwardly from the vertical back wall having at least two apertures for securely receiving the mounting pins; and at least one bracket extending from the vertical back wall to the horizontal support plate for supporting the horizontal support plate.

12 Claims, 4 Drawing Sheets

TOOTHBRUSH HOLDER

FIELD OF THE INVENTION

The present invention relates to a novel toothbrush holder having a base unit and a disposable carrier assembly for the sanitary holding of toothbrushes.

BACKGROUND OF THE INVENTION

With the public concern so prevalent today about germs, bacteria, and diseases that arise therefrom, there is a growing need for products that aid in minimizing their transfer. One area of personal hygiene in which germs and bacteria, and their transfer, are very common, is the oral cavity. The oral cavity and, in particular, the tools used in cleaning it, such as a toothbrush, are notorious havens for disease-causing organisms.

The transfer of germs and bacteria between dental tools or toothbrushes and the mouth is facilitated by non-sanitary storage of these tools between use and/or multiple users of a common area using, then storing their personal hygiene tools or toothbrushes repeatably. Anytime there may be multiple users of an area where personal hygiene devices are stored, such as a toothbrush in a holder, the potential for germ or bacteria transfer exists. Examples include visiting house guests, family, or friends, a house full of children with poor sanitary habits, and hotel rooms in which a different guest uses the facilities each day.

A few U.S. Patents have addressed the storage issue of toothbrushes, in particular. For example, U.S. Pat. No. 1,487,085 discloses a device for holding a tube of toothpaste and a closure therefor, and a holding device for supporting a plurality of toothbrushes.

U.S. Pat. No. 2,916,155 discloses a sanitary disposable holder for oral hygiene devices, such as toothbrushes.

U.S. Pat. No. 3,002,630 discloses a sanitary, disposable, toothbrush rack.

U.S. Pat. No. 5,259,519 discloses a removable toothbrush holder having a rear, T-shaped projection which fits into a permanent holder of somewhat C-shape for slidably supporting the projection.

There does, however, remain a need for safe (i.e., no sharp corners, tilt prevention, etc.), sanitary, easily constructed, disposable toothbrush holder that allows a variety of mounting possibilities (i.e., screws, adhesive, etc.), with a recessed, out-of-the-way area, for logo, instructional, or indicia application.

SUMMARY OF THE INVENTION

The present invention is directed to a disposable holder comprising: a first member and a second member, wherein the first member is a disposable carrier comprising a substantially horizontal carrier plate having at least one opening for receiving a toothbrush; a substantially vertical wall connected to the carrier plate to extend upwardly therefrom; and at least two mounting pins connected to a bottom surface of the carrier plate and opposite the vertical wall; and wherein the second member is a mounting bracket for holding the disposable carrier comprising: a substantially vertical back wall; a substantially horizontal support plate extending outwardly from the vertical back wall having at least two apertures for securely receiving the mounting pins; and at least one bracket extending from the vertical back wall to the horizontal support plate for supporting the horizontal support plate.

In one embodiment, the at least one opening further contains a wall surrounding the opening. Alternatively, the carrier plate has a perimeter and contains a wall along the perimeter. In another embodiment, the carrier plate further contains a ridge perpendicular to the vertical wall. In one embodiment, the back wall further comprises a pressure sensitive adhesive coating for mounting to the mounting surface. In another embodiment, the back wall further comprises at least one aperture for receiving a fastener. In a preferred embodiment, the disposable holder is formed entirely from a thermoplastic. In still another embodiment, the wall comprises a recessed area for receiving indicia. In yet another embodiment, the wall has vertical beams. In a preferred embodiment, the back wall and the vertical beams are coplanar with each other. In another embodiment, the apertures each have a diameter substantially the same as the mounting pins.

DRAWINGS

DETAILED DESCRIPTION OF THE INVENTION

Figure 1:
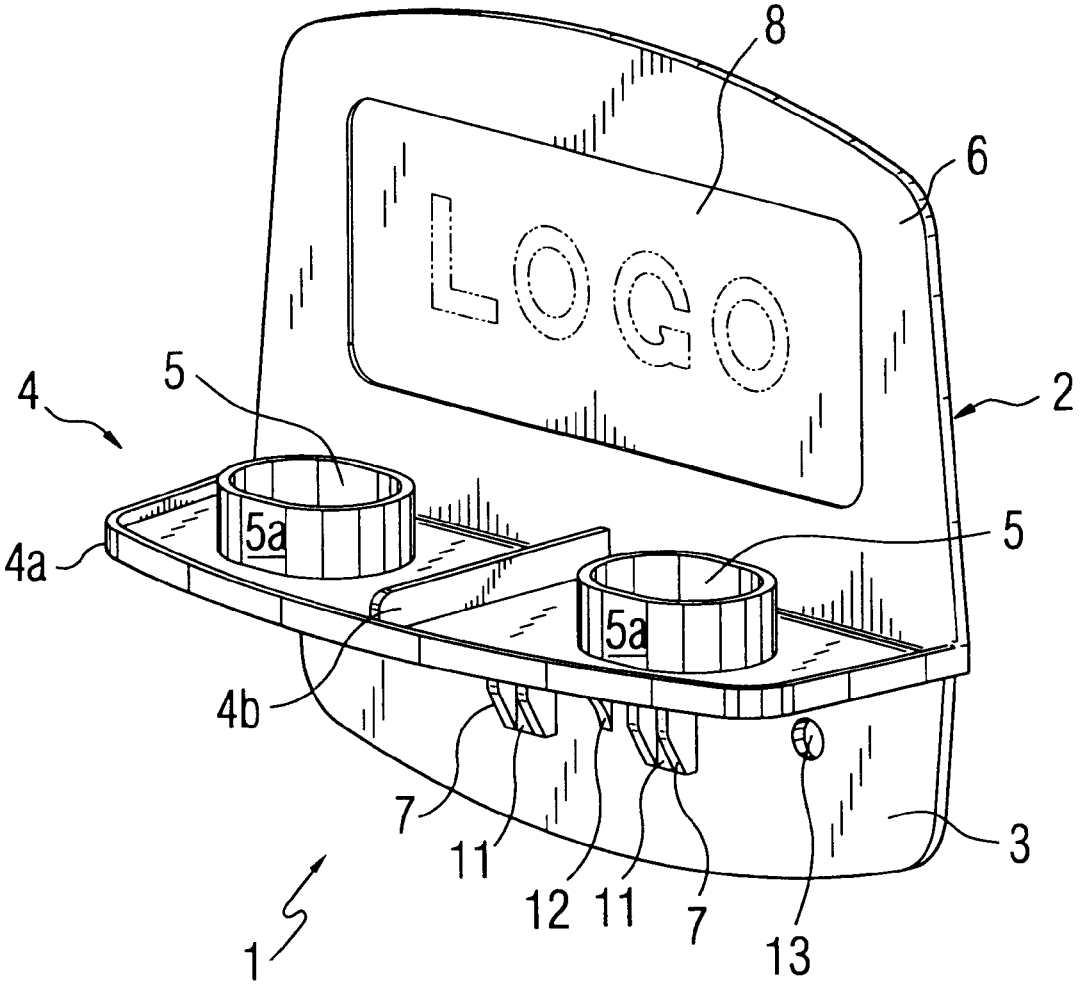
FIG. 1 is a perspective front view of the disposable toothbrush holder.
Figure 2:
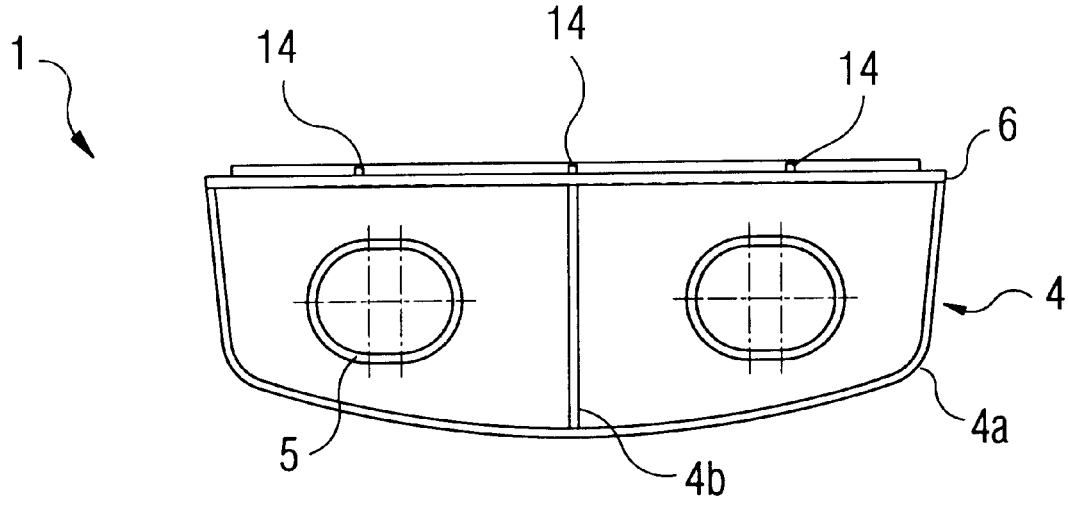
FIG. 2 is a top view of the mounting bracket.
Figure 3:
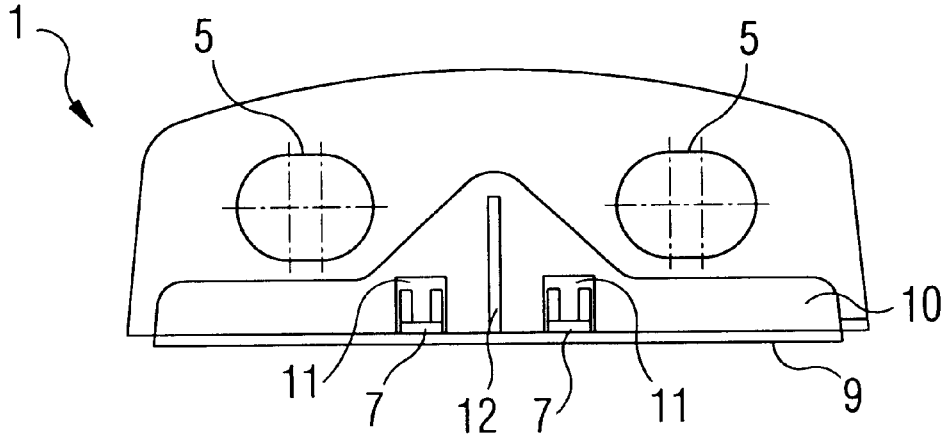
FIG. 3 is a bottom view of the disposable toothbrush holder.
Figure 4:
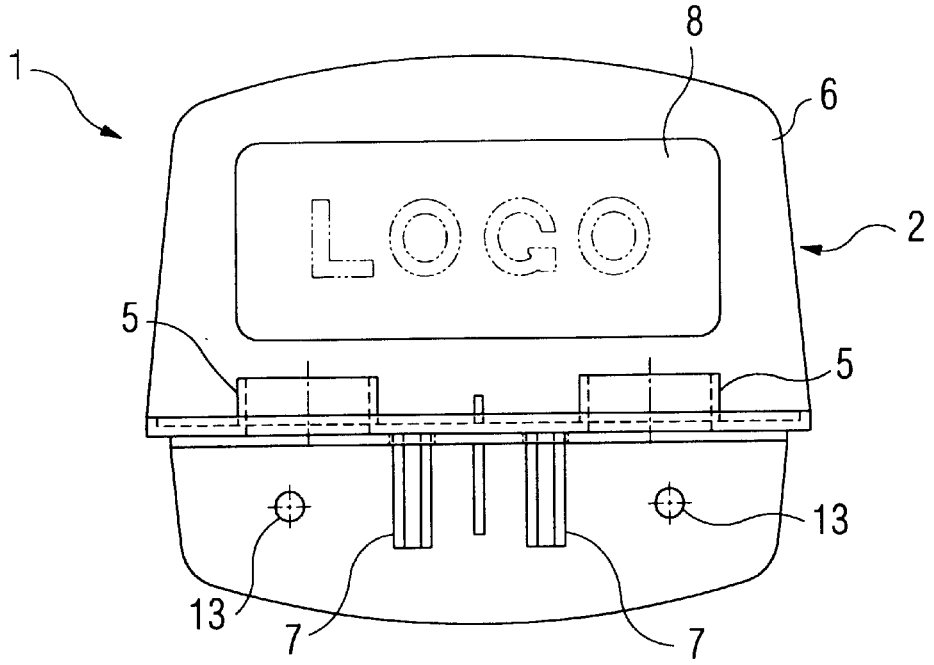
FIG. 4 is a front view of the disposable toothbrush holder.
Figure 5:
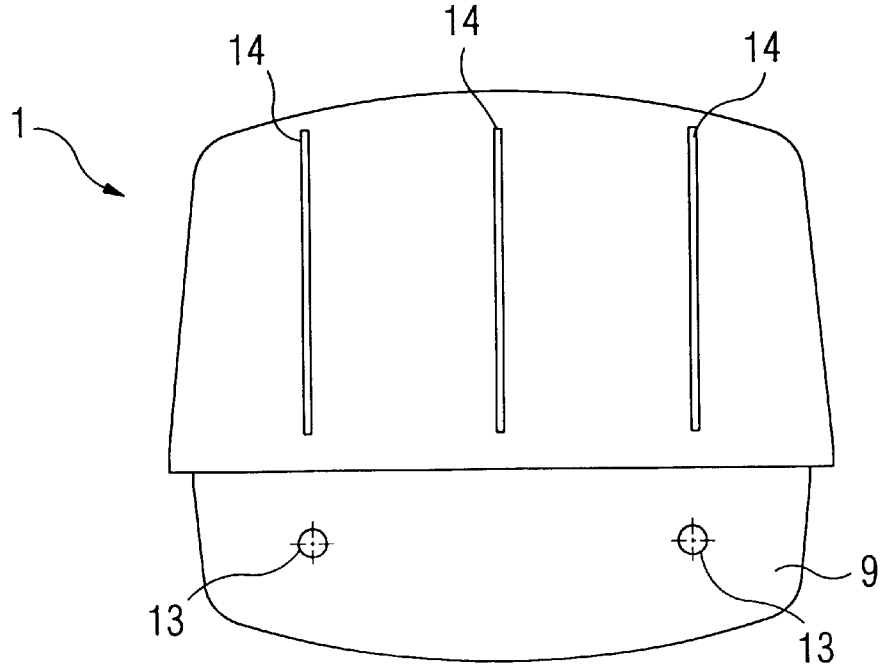
FIG. 5 is a back view of the disposable toothbrush holder.
Figure 6:
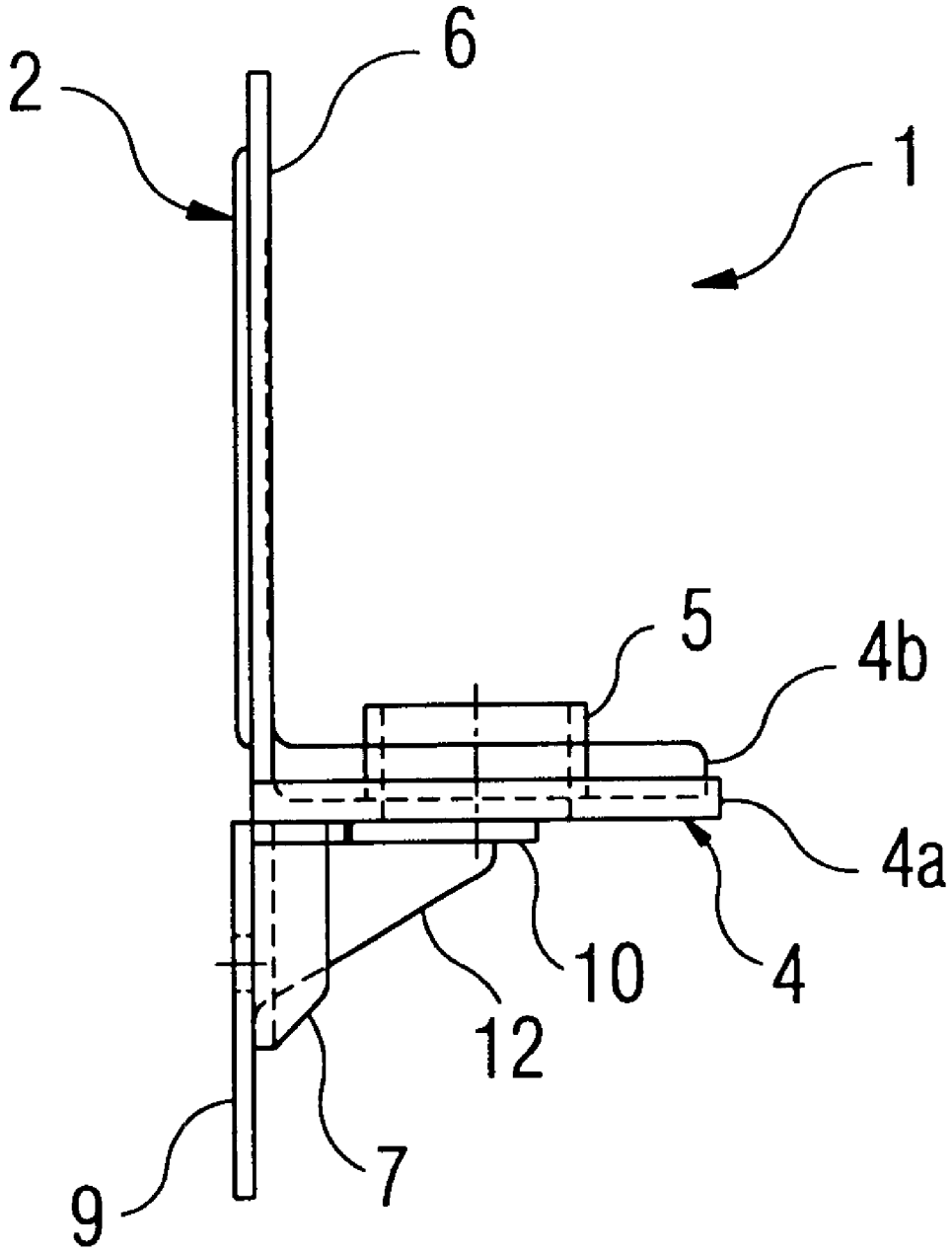
FIG. 6 is a side view of the disposable toothbrush holder.

Referring to FIGS. 1–3, the holder 1 comprises a disposable carrier assembly 2 and a mounting bracket 3. The carrier assembly 2 comprises a carrier plate 4 having at least one opening 5 sized so as to securely hold a hygiene utensil or tool, such as a toothbrush. Preferably, the carrier plate 4 has two receiving openings 5. The carrier plate 4 may be of any shape or dimension but preferably is of a shape having rounded edges for safety reasons. The opening 5 may be of any shape or size sufficient to hold the predetermined tool. Preferably, the opening 5 is oval in shape. The at least one opening 5 is preferably surrounded by a wall 5*a* to aid in keeping the predetermined tool from contacting the surface of thee carrier plate 4. In a preferred embodiment, the carrier plate 4 contains a wall 4*a* along its perimeter. In another embodiment, the carrier plate 4 contains a ridge 4*b* to guard against the spread of fluid that might originate from the predetermined tool.

The carrier assembly 2 further includes an advertisement wall 6 extending substantially perpendicular to the carrier assembly 2 and at least two mounting pins 7 extending substantially perpendicular to the carrier assembly 2 and in substantially in the same plane as but opposite in direction to the wall 6. The wall 6 contains a recessed area 8 in which indicia, such as printed advertising or a logo, may be located. The wall 6 may further contain indicia in other locations, such as engravement above the recessed area 8. The wall 6 may be of any shape or dimension but preferably has rounded edges for safety reasons. Preferably, the wall 6 has substantially the same shape as the carrier plate 4.

Referring to FIG. 2, the carrier assembly 2 also contains at least one tilt prevention stiffener 14 that provide the benefits of at least stiffening the carrier assembly 2 and preventing it from tilting or leaning towards the mounting surface. Preferably, the carrier assembly 2 contains three tilt stiffeners 14 located on the back of the assembly.

The carrier assembly 2 and the components thereof may be constructed of any material having sufficient strength to support the selected hygiene tool, such as stainless steel, aluminum, thermoplastic, or Teflon®. Preferably, the carrier assembly 2 is constructed of thermoplastic.

Referring to FIG. 3, the mounting bracket 3 includes a substantially vertical mounting bracket back wall 9 and a substantially horizontal support plate 10. The support plate 10 further includes at least two mounting pin receiving apertures 11 for receiving mounting pins 7. The mounting pins 7 may be of any geometry, but are preferably of sufficient size and shape to securely interlock the carrier assembly 2 and mounting bracket 3. The mounting pin receiving aperture 11 may be of any diameter sufficient to securely receive the mounting pins 7. Preferably, the mounting pin receiving aperture 11 has a diameter substantially the same as the mounting pins 7. In a preferred embodiment, the mounting pin receiving apertures 11 are rectangular in geometry. At least one stiffening bracket 12 is connected to the horizontal support plate 10 and the vertical back wall 9 such that it is perpendicular to planes defined by both and provides support and stiffening to the horizontal support plate 10. Preferably, there is at least one stiffening bracket 12 located centrally between the edges of the horizontal support plate 10 and the vertical back wall 9. The stiffening bracket 12 may extend for any distance along the horizontal support plate 10 and the vertical back wall 9. Preferably, the stiffening bracket 12 extends the full length of the horizontal support plate 10, extending from the vertical back wall 9 to the edge of the horizontal support plate 10. Additionally, it is preferred that the stiffening bracket 12 extend less than half the width of the vertical back wall 9, such that the mounting bracket 3 is visually appealing.

The mounting bracket may be mounted to a mounting surface in any way sufficient to support the combined weight of the holder 1 and what is held by the holder, such as with, but not limited to, various fasteners, screws, bolts, nails, adhesives, and VELCRO™. The vertical back wall 9 optionally contains at least one aperture 13 for receiving a screw such that the back wall 9 may be threadingly attached to a mounting surface. The mounting bracket back wall 9 optionally includes a pressure sensitive adhesive coating for aid in mounting to a mounting surface. If present, the pressure sensitive adhesive coating may contain an optional protective liner.

The vertical back wall 9 and the horizontal support plate 10 may be of any shape or dimension sufficient to provide support for the carrier assembly 2. Preferably, the vertical back wall 9 and the horizontal support plate 10 have rounded edges for safety reasons. Additionally, it is preferred that the back wall 9 and the tilt stiffeners 14 are coplanar with each other. The mounting bracket 3 and the components thereof may be constructed of any material having sufficient strength to support the selected hygiene tool, such as stainless steel, aluminum, thermoplastic, or Teflon®. Preferably, the mounting bracket 3 is constructed of thermoplastic.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A disposable holder comprising: a first member and a second member, wherein the first member is a disposable carrier comprising:

a substantially horizontal carrier plate having at least one opening for receiving a toothbrush;

a substantially vertical wall connected to the carrier plate to extend upwardly therefrom; and at least two mounting pins connected to a bottom surface of the carrier plate and opposite the vertical wall;

and wherein the second member is a mounting bracket for holding the disposable carrier comprising:

a substantially vertical back wall;

a substantially horizontal support plate extending outwardly from the vertical back wall having at least two apertures for securely receiving the mounting pins; and at least one stiffening bracket extending from the vertical back wall to the horizontal support plate for supporting the horizontal support plate.

2. The holder of claim 1, wherein the back wall further comprises a pressure sensitive adhesive coating for mounting to the mounting surface.

3. The holder of claim 2, wherein the pressure sensitive adhesive coating further comprises a protective liner.

4. The holder of claim 1, wherein the wall has at least one tilt stiffener.

5. The holder of claim 4, wherein the back wall and the at least one tilt stiffener are coplanar with each other.

6. The holder of claim 1, wherein the at least one opening further contains a wall surrounding the opening.

7. The holder of claim 1, wherein the carrier plate has a perimeter and contains a wall along the perimeter.

8. The holder of claim 1, wherein the carrier plate further contains a ridge perpendicular to the vertical wall.

9. The holder of claim 1, wherein the back wall further comprises at least one aperture for receiving a fastener.

10. The holder of claim 1, wherein the disposable holder is formed entirely from a thermoplastic.

11. The holder of claim 1, wherein the wall comprises a recessed area for receiving indicia.

12. The holder of claim 1, wherein the apertures each have a diameter substantially the same as the mounting pins.

* * * * *